US008807743B2

(12) United States Patent
Furuta

(10) Patent No.: US 8,807,743 B2
(45) Date of Patent: Aug. 19, 2014

(54) OPEN-CLOSE COVER ASSEMBLY OF IMAGE FORMING APPARATUS

(71) Applicant: Canon Kabushiki Kaisha, Tokyo (JP)

(72) Inventor: Takashi Furuta, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/659,035

(22) Filed: Oct. 24, 2012

(65) Prior Publication Data

US 2013/0135418 A1 May 30, 2013

(30) Foreign Application Priority Data

Nov. 30, 2011 (JP) ..... 2011-261753

(51) Int. Cl.
*B41J 29/13* (2006.01)

(52) U.S. Cl.
USPC ..... 347/108; 347/102; 347/104

(58) Field of Classification Search
USPC ..... 347/222, 215–220, 172–179
See application file for complete search history.

(56) References Cited

U.S. PATENT DOCUMENTS

| | | | | |
|---|---|---|---|---|
| 4,279,504 | A * | 7/1981 | Brown et al. | 355/72 |
| 6,603,655 | B2 * | 8/2003 | Hrehor et al. | 361/679.6 |
| 2006/0028528 | A1 * | 2/2006 | Klein et al. | 347/109 |
| 2012/0056960 | A1 * | 3/2012 | Williams | 347/108 |

FOREIGN PATENT DOCUMENTS

| | | | | |
|---|---|---|---|---|
| JP | 06-088702 | | 11/1994 | |
| JP | 2001189566 | A * | 7/2001 | H05K 5/02 |
| JP | 4449761 | | 4/2010 | |

* cited by examiner

*Primary Examiner* — Matthew Luu
*Assistant Examiner* — Lily Kemathe
(74) *Attorney, Agent, or Firm* — Cowan, Liebowitz & Latman, P.C.

(57) ABSTRACT

An open-close cover assembly of an image forming apparatus capable of maintaining an open angle of an open-close cover even when sheets of large quantity are stacked on the cover and preventing the cover and an apparatus main unit from being damaged even when the cover is applied with an excessive force acting in a cover opening direction. When the cover is in open state, first stopper portions of the cover are engaged with first receiving portions of the main unit, thereby maintaining the cover open angle. When an excessive force is applied to the cover, shaft portions of the main unit are disengaged from bearing portions of the cover through openings formed in the bearing portions after the first stopper portions have been disengaged from the first receiving portions and second stopper portions of the cover have been engaged with second receiving portions of the main unit.

6 Claims, 8 Drawing Sheets

OPEN-CLOSE COVER ASSEMBLY OF IMAGE FORMING APPARATUS

BACKGROUND OF THE INVENTION

1. Field of the Invention

The present invention relates to an open-close cover assembly of an image forming apparatus.

2. Description of the Related Art

There is known an image forming apparatus (e.g., a printer) in which an image is formed on a roll sheet, an image-formed portion of the roll sheet is cut into an image-formed sheet, and the image-formed sheet is discharged upwardly.

Such image forming apparatus has a sheet discharge unit provided with an open-close cover that is opened for use as a sheet tray on which image-formed sheets can be placed upright and stacked. It should be noted that in a case where image-formed sheets of large quantity are discharged and stacked on the open-close cover, a cover open angle must be accurately maintained for smooth sheet discharge and stacking operations.

If the open-close cover which is in an open state is applied with an excessive force acting in a direction to open the cover, the cover can be damaged and/or a cover mounting part of a main unit of the image forming apparatus can be damaged.

Accordingly, a cover open-close mechanism has been proposed (Japanese Patent Publication No. 4449761) that has a cover provided at its both ends with a pair of hinge bases on which protrusions are formed so as to be fitted into holes that are formed in a pair of hinge receiving portions provided in an apparatus main unit, thereby rotatably mounting the cover to the apparatus main unit. One of the hinge receiving portions is formed with a rotation prevention part that prevents the cover from rotating. When the cover is applied with an excessive force acting in a cover opening direction, one side of the cover in which the rotation prevention part is not provided is largely opened. As a result, the cover is twisted and detached from the apparatus main body, thereby preventing the cover and/or the apparatus main body from being damaged.

However, when an excessive force is applied to another side of the cover in which the rotation prevention part is provided, the cover is hardly detached from the apparatus main unit. This causes a fear that the cover and/or the apparatus main unit can be damaged. In addition, the strength for withstanding a force acting in a cover opening direction is not sufficient since the rotation prevention part is only provided on one side of the cover. Accordingly, when image-formed sheets of large quantity are stacked on the cover, the cover is inclined rearwardly and the open angle of the cover becomes large, thereby sometimes preventing smooth sheet discharge.

A sheet feed tractor has also been proposed (Japanese Examined Patent Application Publication No. H06-088702 and corresponding U.S. Pat. No. 5,127,568), in which a pair of hinge pins are provided in a lid and fitted into grooves formed in a pair of hinges provided in a frame to thereby openably and closeably mount the lid to the frame, and in which one of the hinges has an extension formed by an elastically deformable stopper. When the lid is applied with an excessive force acting in a lid opening direction, the stopper of the frame is elastically deformed, so that the lid is detached from the stopper and prevented from being damaged.

However, if a user does not restore the lid detached from the stopper to an original position and if the lid is subsequently applied with an excessive force acting in the lid opening direction, the lid can be damaged.

SUMMARY OF THE INVENTION

The present invention provides an open-close cover assembly of an image forming apparatus capable of maintaining an open angle of an open-close cover even when sheets of large quantity are stacked on the cover and capable of preventing the cover and an apparatus main unit from being damaged even when the cover is applied with an excessive force acting in a cover opening direction.

According to the present invention, there is provided an open-close cover assembly of an image forming apparatus comprising an open-close cover supported for rotation in opening and closing directions relative to an image forming apparatus main unit and configured in an open state to be stacked with sheets, bearing portions formed in one of the image forming apparatus main unit and the open-close cover and each formed with an opening, elastically deformable arm portions extending to another of the image forming apparatus main unit and the open-close cover respectively from vicinities of parts of the one of the image forming apparatus main unit and the open-close cover where the bearing portions are formed, first stopper portions respectively provided at tip ends of the arm portions, second stopper portions respectively provided in the one of the image forming apparatus main unit and the open-close cover at locations spaced away from the first stopper portions, shaft portions provided in the other of the image forming apparatus main unit and the open-close cover and configured to be fitted respectively into the bearing portions through the openings, first receiving portions provided in the other of the image forming apparatus main unit and the open-close cover and configured to be detachably engaged respectively with the first stopper portions when the open-close cover is in the open state, thereby restricting an open angle of the open-close cover, and second receiving portions provided in the other of the image forming apparatus main unit and the open-close cover and configured to be detachably engaged respectively with the second stopper portions when the first stopper portions are elastically deformed and disengaged respectively from the first receiving portions in a case where the open-close cover, which is in the open state, is applied with a force acting in a direction to open the open-close cover, wherein the shaft portions are disengaged respectively from the bearing portions through the openings after the first stopper portions have been disengaged from the first receiving portions and the second stopper portions have been engaged with the second receiving portions.

With this invention, it is possible to accurately maintain the open angle of the open-close cover even when sheets of large quantity are stacked on the cover, and it is also possible to prevent the open-close cover and the apparatus main unit from being damaged even when the open-close cover is applied with an excessive force acting in a direction to open the cover.

Further features of the present invention will become apparent from the following description of exemplary embodiments with reference to the attached drawings.

DESCRIPTION OF THE EMBODIMENTS

The present invention will now be described in detail below with reference to the drawings showing preferred embodiments thereof.

First Embodiment

Figure 1:
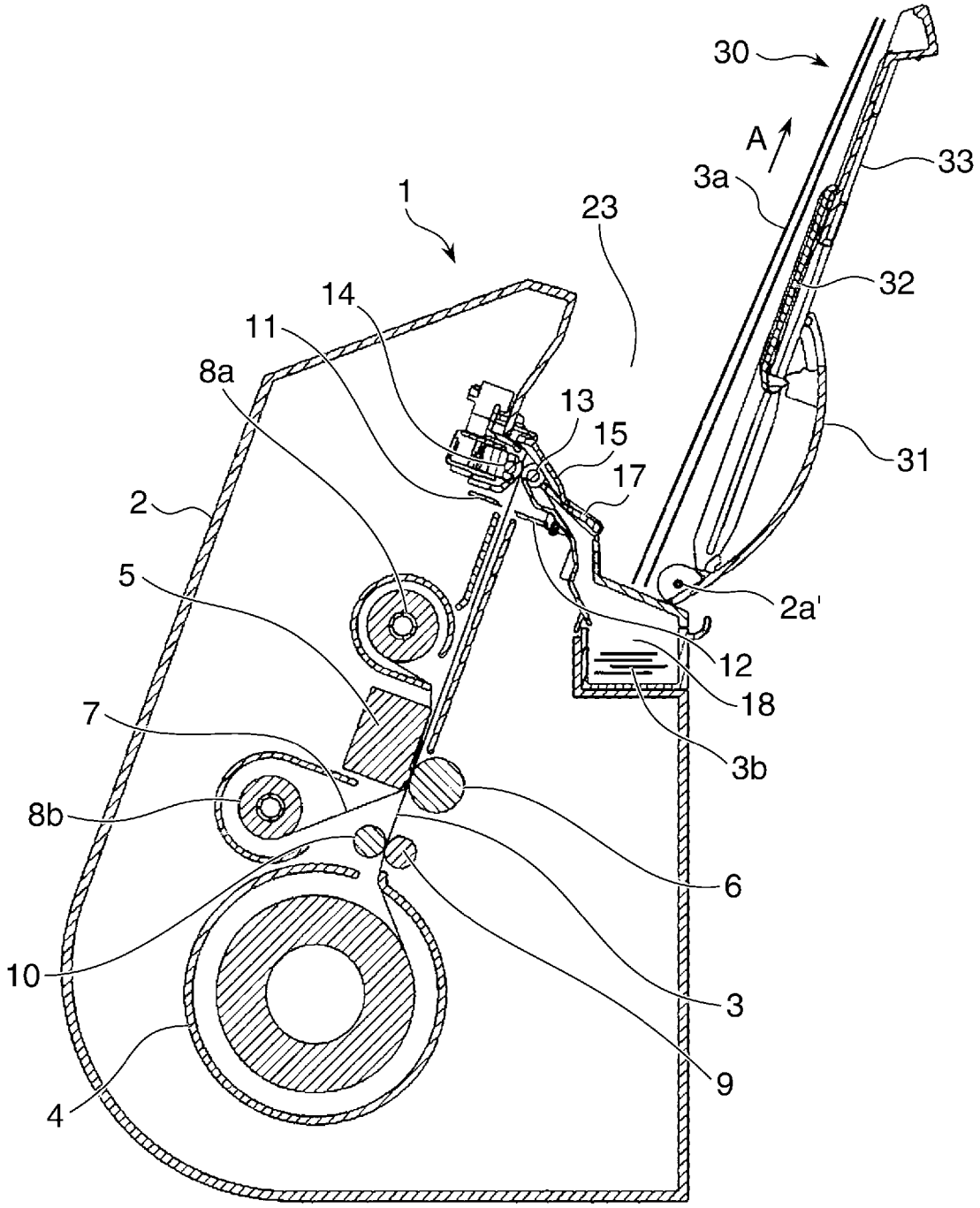
FIG. 1 is a schematic section view showing a printer, which is an example of an image forming apparatus and which has an open-close cover unit serving as an open-close cover assembly according to a first embodiment of this invention.

FIG. 1 shows, in schematic section view, a printer which is an example of an image forming apparatus and which has an open-close cover unit serving as an open-close cover assembly according to a first embodiment of this invention.

In FIG. 1, reference numeral 1 denotes a printer that uses a roll sheet 3. The printer 1 has a printer main unit 2 (image forming apparatus main unit) and an open-close cover unit 30 mounted to an upper rear face of the printer main unit 2.

Inside the printer main unit 2, there are disposed a sheet cassette 4 in which the roll sheet 3 is loaded and a platen roller 6 which is rotatably supported by a frame of the printer main unit 2. An ink ribbon 7 is supplied from a supply bobbin 8*a* and taken up by a take-up bobbin 8*b*. A thermal head 5 is pressed against the platen roller 6. The roll sheet 3 and the ink ribbon 7 are held between the thermal head 5 and the platen roller 6.

Under the control of a controller (not shown) of the printer 1, a grip roller 9 is driven by a stepping motor (not shown) to convey the roll sheet 3. Reference numeral 10 denotes a pinch roller. When the roll sheet 3 is conveyed by the grip roller 9, the take-up bobbin 8*b* is rotatably driven by a motor (not shown), whereby the ink ribbon 7 is taken up by the take-up bobbin 8*b*. The thermal head 5 generates heat and thermally transfers ink of the ink ribbon 7 to the roll sheet 3, whereby the roll sheet 3 is printed with characters, images, and the like.

Subsequently, the roll sheet 3 is conveyed until a leading end of the image-formed portion of the sheet 3 (more specifically, a tip end of an upstream margin of the image-formed portion of the sheet 3) reaches a cutting position. At this conveyance position, the roll sheet 3 is cut by a movable cutter blade 11 and a stationary cutter blade 12. Since, at that time, a guide member 17 is at a chip discharge position, chip 3*b* is discharged into a chip receiving box 18.

Next, the roll sheet 3 is conveyed until a trailing end of the image-formed portion of the sheet 3 (more specifically, a rear end of a downstream margin of the image-formed portion of the sheet 3) reaches the cutting position. At this conveyance position, the roll sheet 3 is cut by the cutter blades 11, 12 to obtain an image-formed sheet 3*a*. Since, at that time, the guide member 17 is at a sheet discharge position, the image-formed sheet 3*a* is discharged from the printer main unit 2 to a stacking part 23 of the open-close cover unit 30, which is in an open state.

The open-close cover unit 30 includes an open-close cover 31 supported by the printer main unit 2 for rotation in open and close directions relative to the printer main unit 2, and includes slide members 32, 33 that can be drawn out in a two-stage fashion from the cover 31 in a direction shown by arrow A in FIG. 1. FIG. 1 shows the slide members 32, 33 in a state drawn out to the maximum. In the printer 1, image-formed sheets 3*a* are each discharged upward from the printer main unit 2 in a state that the open-close cover 31 is open. Discharged sheets 3*a* are placed upright and stacked on the slide members 32, 33.

Next, with reference to FIGS. 2A and 2B, a description will be given of how image-formed sheets 3*a* are discharged.

Figure 2A:
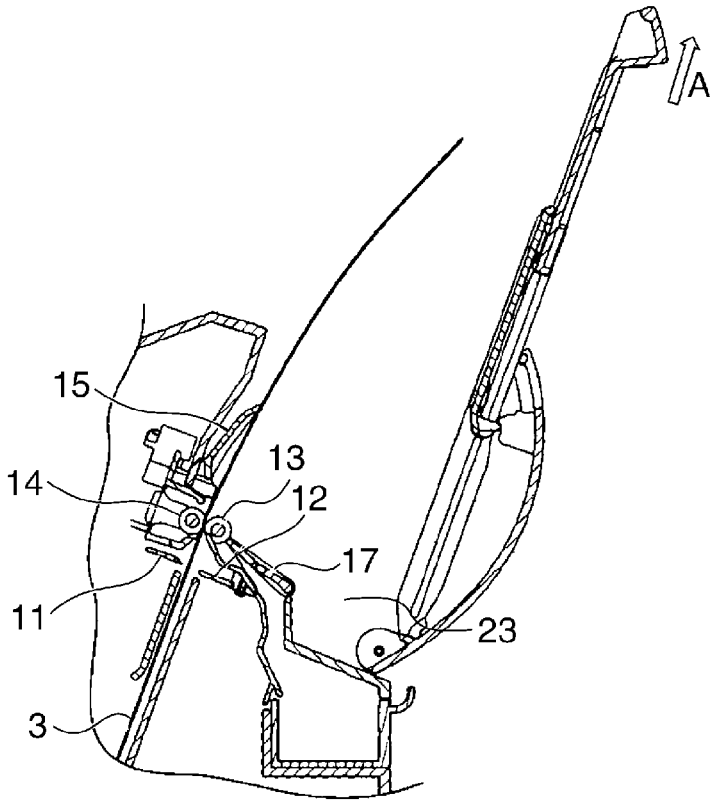
FIG. 2A is a fragmentary section view showing a state where a roll sheet is conveyed until a trailing end of an image-formed portion of the roll sheet reaches a cutting position.
Figure 2B:
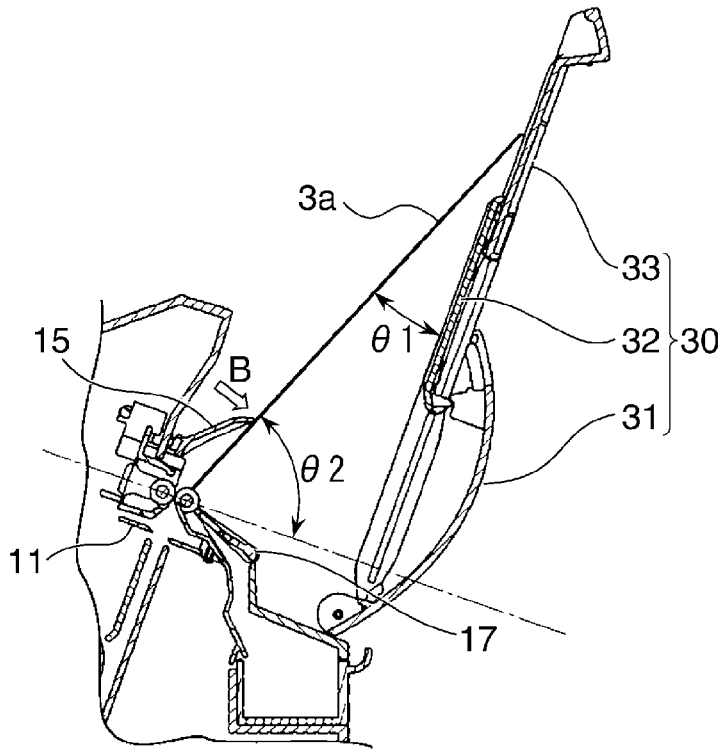
FIG. 2B is a fragmentary section view showing a state where an image-formed sheet obtained by cutting the image-formed portion of the roll sheet is discharged from a printer main unit.

FIGS. 2A and 2B respectively show, in fragmentary section view, a state where the roll sheet 3 is conveyed until a trailing end of an image-formed portion of the sheet 3 reaches the cutting position and a state where an image-formed sheet 3*a* obtained by cutting the image-formed portion of the roll sheet 3 is discharged from the printer main unit 2.

With rotation of a sheet discharge roller 13, the roll sheet 3 is conveyed in a state held between the sheet discharge roller 13 and a driven roller 14 of the printer main unit 2. The rotation of the roller 13 is temporarily stopped at the sheet conveyance position shown in FIG. 2A, and the roll sheet 3 is cut by the cutter blades 11, 12 to obtain an image-formed sheet 3*a*.

Subsequently, the rotation of the sheet discharge roller 13 is restarted to further convey the image-formed sheet 3*a* in the sheet discharge direction. When the trailing end of the image-formed sheet 3*a* has passed through between the sheet discharge roller 13 and the driven roller 14, the image-formed sheet 3*a* is pushed out by an extrusion member 15 toward the stacking part 23 as shown in FIG. 2B. The extrusion member 15 is urged by a spring (not shown) in a closing direction shown by arrow B in FIG. 2B.

The image-formed sheet 3*a* is pushed at its rear end portion by the extrusion member 15, while a tip end portion of the sheet 3*a* abutting against the slide member 32 or 33 (the slide member 33 in the illustrated example) of the open-close cover unit 30 serves as a fulcrum, and is stacked in the stacking part 23 of the cover unit 30.

If an angle θ1 is large that is formed between the image-formed sheet 3*a* and the slide member (e.g., slide member 33) against which the tip end portion of the sheet 3*a* abuts, there is a possibility that the rear end of the image-formed sheet 3*a* slips on the sheet discharge roller 13 or the sheet 3*a* is caused to remain near the position beyond the roller 13. In that case, the image-formed sheet 3*a* cannot be pushed out toward the stacking part 23 of the cover unit 30, whereby the discharge of the next image-formed sheet is hindered, resulting in sheet jam or other problem.

If the open-close cover 31 of the cover unit 30 is excessively opened, so that an orientation angle θ2 of the image-formed sheet 3*a* becomes excessively small, the rear end of the sheet 3*a* cannot be pushed out by the extrusion member 15 toward the stacking part 23, which results in sheet jam or other problem. It is therefore necessary to accurately maintain the open angle of the open-close cover 31.

Figure 3:
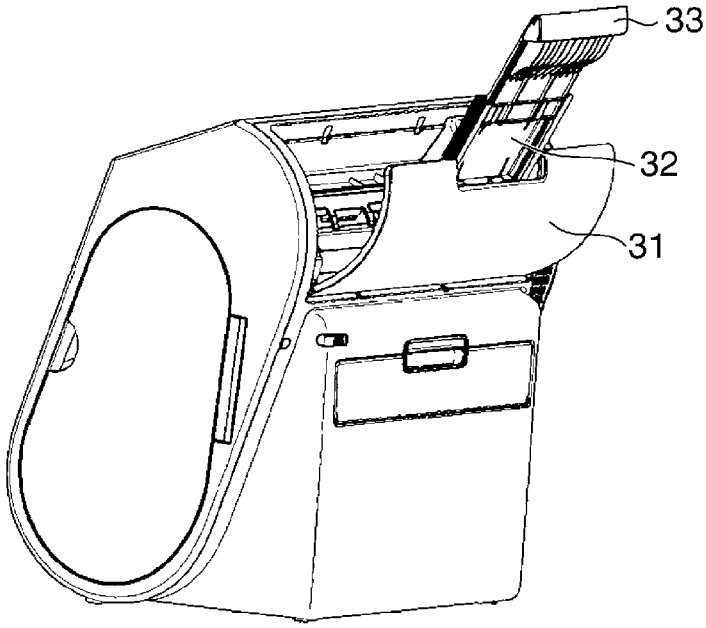
FIG. 3 is a rear perspective view showing the printer in a state where an open-close cover of the open-close cover unit is open.
Figure 4:
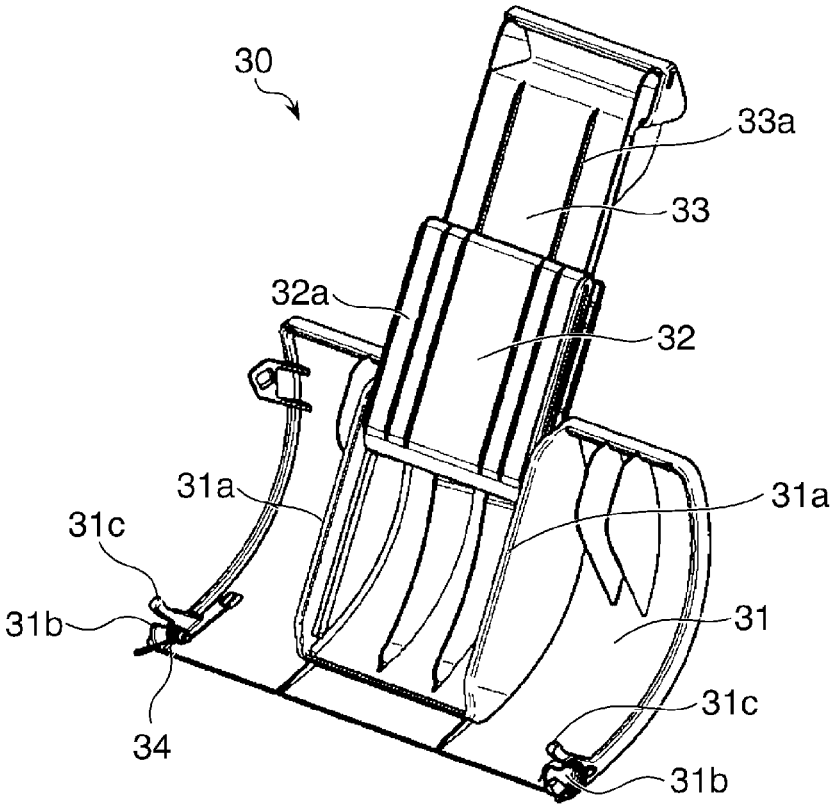
FIG. 4 is a front perspective view of the open-close cover unit.
Figure 5:
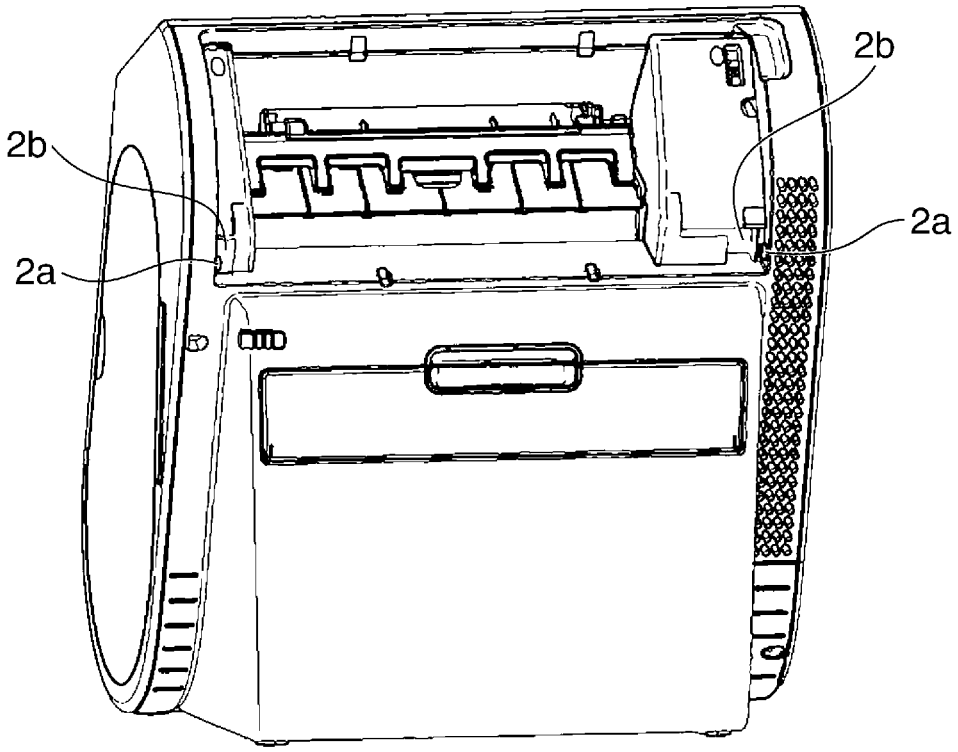
FIG. 5 is a rear view of the printer main unit.
Figure 6A:
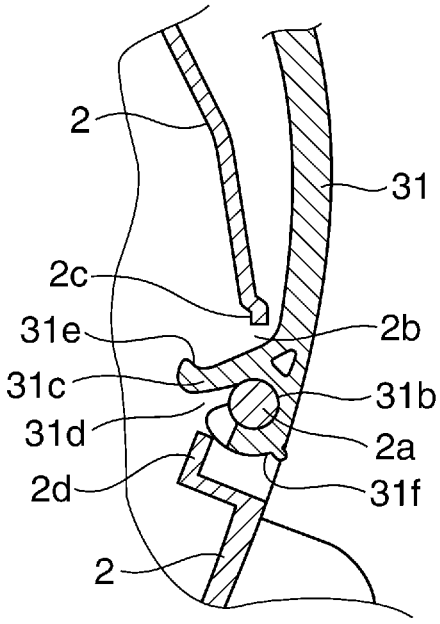
FIG. 6A is a fragmentary enlarged section view showing a state where the open-close cover is closed.
Figure 6B:
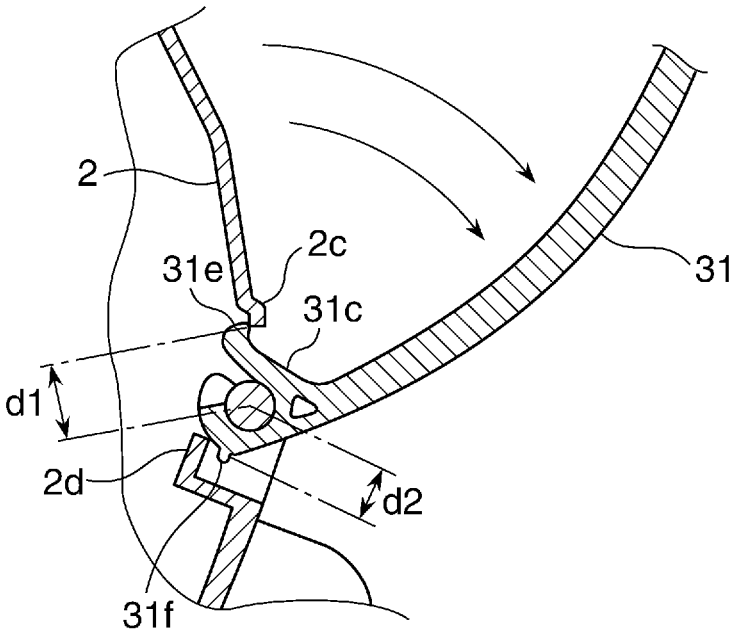
FIG. 6B is a fragmentary enlarged section view showing a state where the open-close cover is open.

FIG. 3 shows the printer 1 in rear perspective view in a state where the open-close cover 31 is open, FIG. 4 shows the open-close cover unit 30 in front perspective view, and FIG. 5 shows the printer main unit 2 in rear view. FIGS. 6A and 6B respectively show, in fragmentary enlarged section view, states where the open-close cover 31 is closed and where the cover 31 is open.

In FIGS. 3 and 4, the slide members 32, 33 of the open-close cover unit 30 are drawn out to the maximum from the open-close cover 31. As shown in FIG. 4, the open-close cover 31 and the slide members 32, 33 are respectively formed with ribs 31*a*, 32*a*, and 33*a* that support an image-formed sheet 3*a* discharged from the printer main unit 2.

A pair of bearing portions 31*b* and a pair of elastically deformable arm portions 31*c* are formed at both widthwise sides of a lower portion of an inner surface of the open-close cover 31. A torsion spring 34 that urges the cover 31 in an opening direction is provided at one widthwise side of the lower portion of the inner surface of the cover 31.

As shown in FIG. 5, a pair of shaft portions (pivot shafts) 2*a* which are rotatably fitted into the bearing portions 31*b* of the cover 31, and a pair of holes 2*b* into which the arm portions 31*c* of the cover 31 are inserted are formed at both widthwise sides of a cover unit mounting face of the printer main unit 2 on which the open-close cover unit 30 is mounted. The shaft portions 2*a* each have an axis denoted by reference numeral 2*a*' in FIG. 1.

As shown in FIGS. 6A and 6B, openings 31*d* each having opposite circumferential ends are formed in the inner surface of the open-close cover 31 by notching circumferential parts of the bearing portions 31*b*. The shaft portions 2*a* formed on the printer main unit 2 can be fitted into the bearing portions 31*b* through the openings 31*d*.

The arm portions 31*c* of the open-close cover 31 are formed at near those parts of the cover 31 where the bearing portions 31*b* are formed (at parts upward of the bearing portions 31*b* in this example). Each arm portion 31*c* extends toward the inside of the printer main unit 2 from one of the opposite circumferential ends (that corresponds to the plane of FIG. 6A or 6B) of the corresponding opening 31*d* formed in the inner surface of the cover 31. First stopper portions 31*e* are formed at tip ends of the arm portions 31*c*, and second stopper portions 31*f* are formed at locations spaced away from the first stopper portions 31*e*. In this example, the second stopper portions 31*f* are formed on an outer surface of the open-close cover 31 at locations downward of the bearing portions 31*b*.

On the cover unit mounting face of the printer main unit 2, first receiving portions 2*c* are formed so as to face the holes 2*b* formed in the cover unit mounting face. When the open-close cover 31 is in the open state shown in FIG. 6B, the first receiving portions 2*c* are detachably engaged with the first stopper portions 31*e*, whereby the open angle of the open-close cover 31 can accurately be maintained.

Figure 7A:
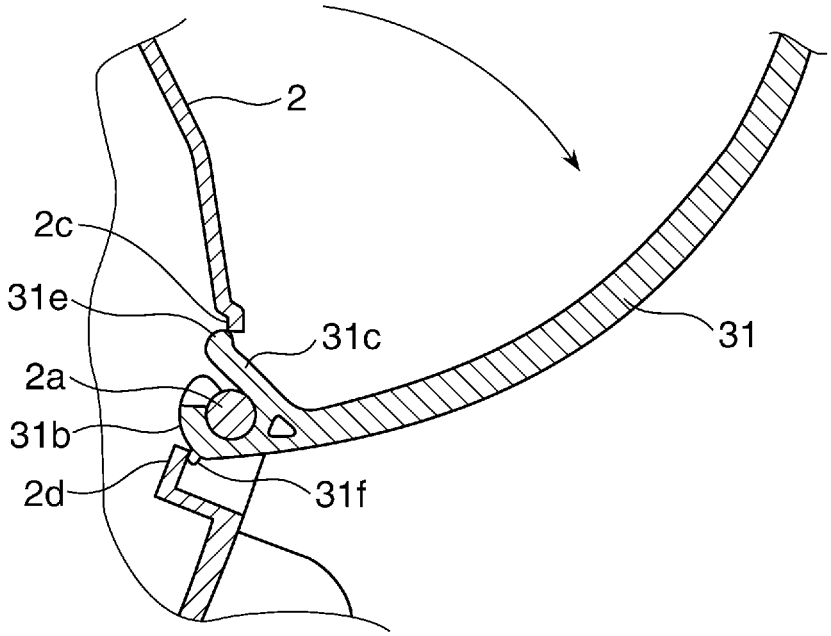
FIG. 7A is a fragmentary enlarged section view showing a state where a first stopper portion of the open-close cover is being disengaged from a first receiving portion of the printer main unit.
Figure 7B:
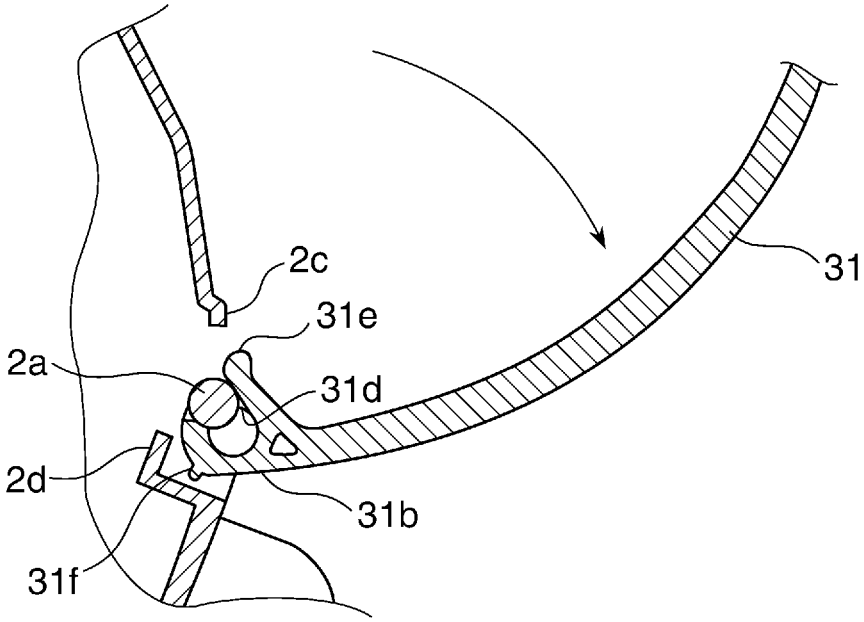
FIG. 7B is a fragmentary enlarged section view showing a state where the first stopper portion of the open-close cover has been disengaged from the first receiving portion of the printer main unit.

FIGS. 7A and 7B respectively show, in fragmentary enlarged section view, a state where the first stopper portion 31*e* of the open-close cover 31 is being disengaged from the first receiving portion 2*c* of the printer main unit 2 and a state where the first stopper portion 31*e* has been disengaged from the first receiving portion 2*c*.

When the open-close cover 31 which is in the open state shown in FIG. 6B is applied with an excessive force acting in a cover opening direction, a large force acting in a direction to move the open-close cover 31 away from the printer main unit 2 is generated at engagement parts between the first stopper portions 31*e* of the cover 31 and the first receiving portions 2*c* of the printer main unit 2. As a result, the arm portions 31*c* of the open-close cover 31 are elastically deformed and the first stopper portions 31*e* are started to be disengaged from the first receiving portions 2*c* as shown in FIG. 7A. Then, the second stopper portions 31*f* of the open-close cover 31 are brought to be detachably engaged with the second receiving portions 2*d* of the printer main unit 2. As a result, it becomes possible to avoid an unstable state caused by disengagement of the first stopper portions 31*e* from the first receiving portions 2*c*.

In this embodiment, the second stopper portions 31*f* of the open-close cover 31 are engaged with the second receiving portions 2*d* of the printer main unit 2 before the first stopper portions 31*e* of the cover 31 have been disengaged from the first receiving portions 2*c* of the main unit 2. It is therefore possible to alleviate the ability to hold the cover 31 attained by the engagement between the first stopper portions 31*e* and the first receiving portions 2*c*.

As previously described, after the first stopper portions 31*e* of the open-close cover 31 have been disengaged from the first receiving portions 2*c* of the printer main unit 2 and after the second stopper portions 31*f* have been engaged with the second receiving portions 2*d*, the shaft portions 2*a* of the printer main unit 2 are disengaged from the bearing portions 31*b* of the cover 31 through the openings 31*d* as shown in FIG. 7B, so that the open-close cover 31 is detached from the printer main unit 2. In other words, the open-close cover unit 30 is dismounted from the printer main unit 2.

In this embodiment, a distance d1 from the center of each of the shaft portions 2*a* to the corresponding first stopper portion 31*e* is made longer than a distance d2 from the center of the shaft portion 2*a* to the corresponding second stopper portion 31*f*. As a result, loads required to cause the second stopper portions 31*f* to be disengaged from the second receiving portions 2*d* become smaller than loads required to cause the first stopper portions 31*e* to be disengaged from the first receiving portions 2*c*. Loads applied to the shaft portions 2*a* of the printer main unit 2 when passing through the openings 31*d* of the open-close cover 31 are also decreased.

As described above, in this embodiment, the open angle of the open-close cover 31 is maintained by the engagement between the first stopper portions 31*e* of the cover 31 and the first receiving portions 2*c* of the printer main unit 2, whereby the open angle of the cover 31 can accurately be maintained even when image-formed sheets 3*a* of large quantity are stacked on the cover 31.

When the open-close cover 31 is applied with an excessive force, the arm portions 31*c* are elastically deformed whereby the first stopper portions 31*e* are disengaged from the first receiving portions 2*c*, and the second stopper portions 31*f* are engaged with the second receiving portions 2*d*. Then, the shaft portions 2*a* are disengaged from the bearing portions 31*b*, so that the open-close cover unit 30 is dismounted from the printer main unit 2. It is therefore possible to prevent the open-close cover 31 and the printer main unit 2 from being damaged, even if the cover 31 is applied with an excessive force acting in a cover opening direction.

In this embodiment, by inserting the arm portions 31*c* into the holes 2*b* and by fitting the shaft portions 2*a* into the bearing portions 31*b* through the openings 31*d*, the open-close cover unit 30 can easily be mounted to the printer main unit 2.

It should be noted that a case where the bearing portions 31*b* are provided in the open-close cover 31 and the shaft portions 2*a* are provided in the printer main unit 2 has been described in the first embodiment, however, it is possible to provide the shaft portions in the open-close cover 31 and provide the bearing portions in the printer main unit 2.

Second Embodiment

Next, with reference to FIGS. 8 to 10, a description will be given of a printer serving as an example of an image forming apparatus and having an open-close cover unit, which is an open-close cover assembly according to a second embodiment of this invention. It should be noted that elements similar to corresponding elements in the first embodiment are denoted by reference numerals which are not the same as but similar to reference numerals in the first embodiment, and these elements will be briefly described below.

Figure 8:
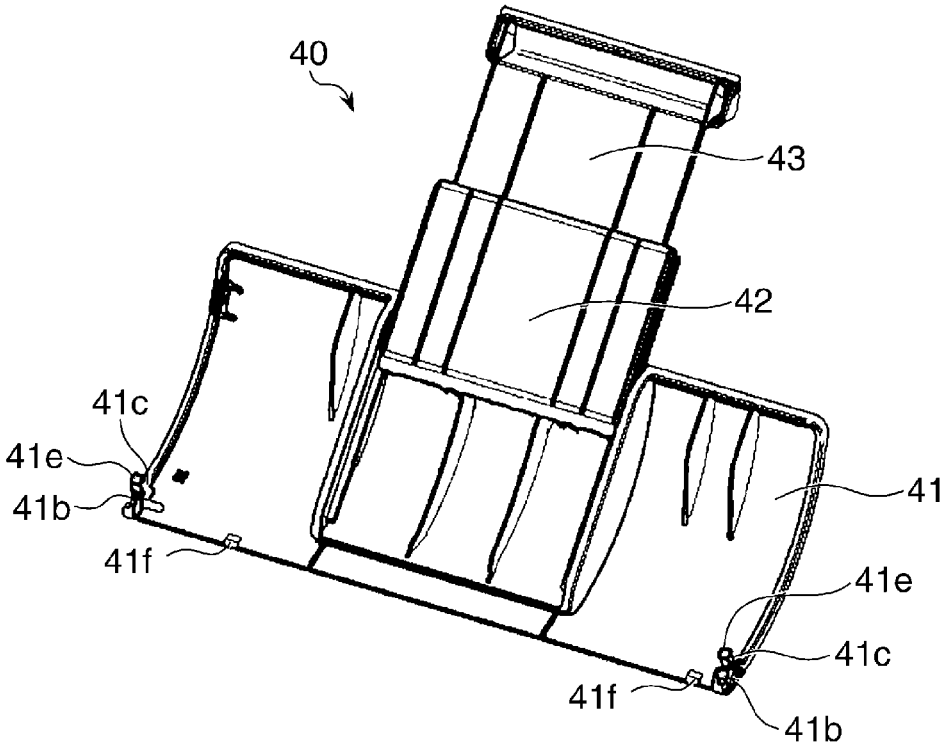
FIG. 8 is a front perspective view of an open-close cover unit serving as an open-close cover assembly according to a second embodiment of this invention, which is mounted to a printer serving as an example of an image forming apparatus.
Figure 9:
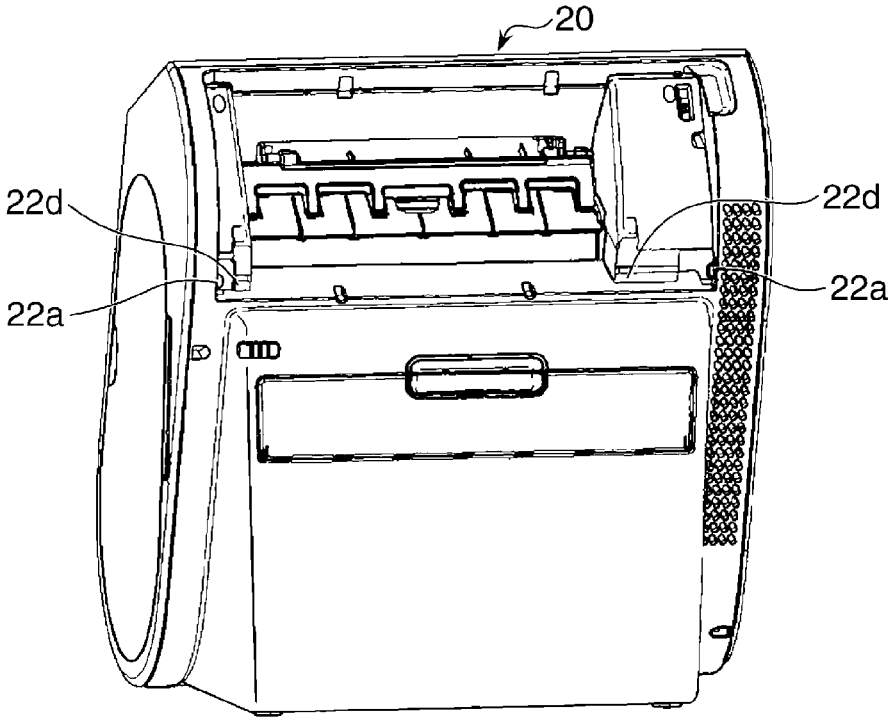
FIG. 9 is a rear perspective view of a printer main unit.
Figure 10A:
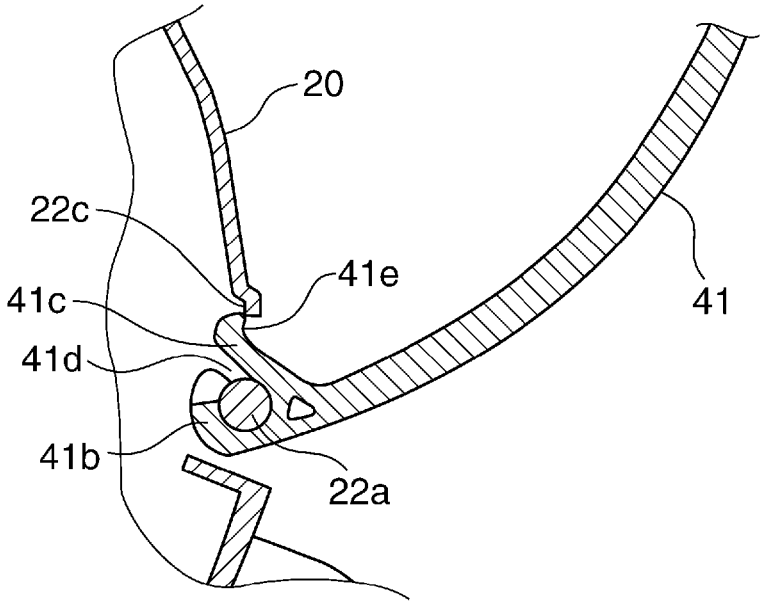
FIG. 10A is a fragmentary enlarged section view showing a first stopper portion and its peripheral structure in a state where the open-close cover is in an open state.
Figure 10B:
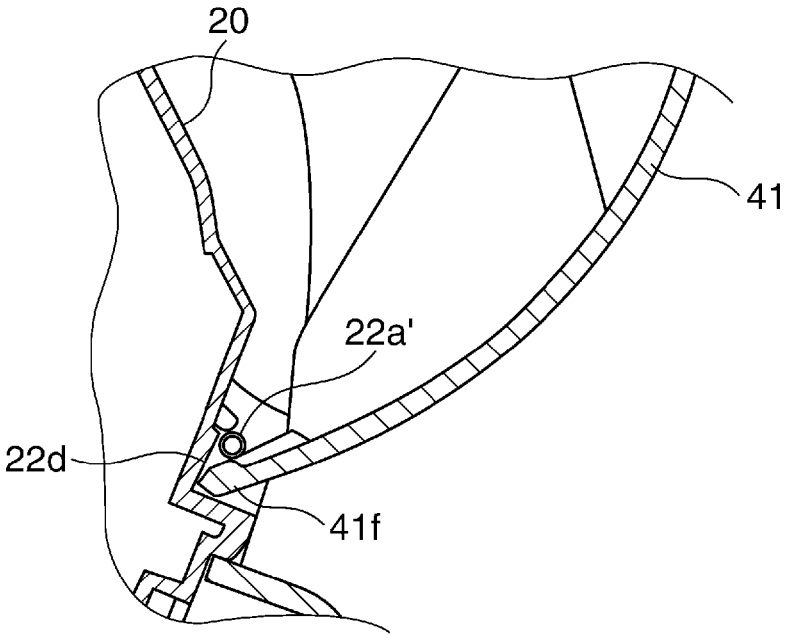
FIG. 10B is a fragmentary enlarged section view showing a second stopper portion and its peripheral structure in a state where the open-close cover is in the open state.

FIG. 8 shows the open-close cover unit 40 in front perspective view, and FIG. 9 shows the printer main unit 20 in rear perspective view. FIGS. 10A and 10B respectively show, in fragmentary enlarged section view, a first stopper portion 41*e* and its peripheral structure and a second stopper portion 41*f* and its peripheral structure in a state where the open-close cover 41 is in an open state.

As shown in FIG. 8, the open-close cover unit 40 includes the open-close cover 41 having a pair of bearing portions 41*b*, a pair of arm portions 41*c*, a pair of first stopper portions 41*e*, and a pair of second stopper portions 41*f*, and includes slide members 42, 43. As shown in FIGS. 9, 10A and 10B, the printer main unit 20 includes a pair of shaft portions 22*a* (pivot shafts), a pair of first receiving portions 22*c*, and a pair of second receiving portions 22*d*. In FIG. 10B, reference numeral 22*a*' denotes an axis of each of the shaft portions 22*a*.

The second stopper portions 41*f* are each provided inwardly of and spaced away from the corresponding bearing portion 41*b* as seen in the widthwise direction of the open-close cover 41. When the cover 41 is in an open state, the second stopper portions 41*f* are disposed to face the second receiving portions 22*d* of the printer main unit 2 with a gap therebetween as seen in the opening direction of the cover 41 (see FIG. 10B).

When the open-close cover 41, which is in an open state shown in FIGS. 10A and 10B, is applied with an excessive force, a large force acting in a direction to move the cover 41 away from the printer main unit 20 is generated at engagement parts between the first stopper portions 41*e* of the cover 41 and the first receiving portions 22*c* of the printer main unit 20. As a result, the arm portions 41*c* of the cover 41 are elastically deformed, so that the first stopper portions 41*e* are disengaged from the first receiving portions 22*c*. Then the second stopper portions 41*f* of the cover 41 are engaged with the second receiving portions 22*d* of the printer main unit 20. Subsequently, as with the case of the first embodiment, the shaft portions 22*a* of the printer main unit 20 are disengaged from the bearing portions 41*b* of the cover 41 through the openings 41*d*. Thus, the open-close cover 41 is detached from the printer main unit 20. In other words, the open-close cover unit 40 is dismounted from the printer main unit 20. The second embodiment is the same in other structure, function, and advantage as the first embodiment, and a description thereof is omitted herein.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-261753, filed Nov. 30, 2011, which is hereby incorporated by reference herein in its entirety.

What is claimed is:

1. An open-close cover assembly of an image forming apparatus, comprising:

an open-close cover supported for rotation in opening and closing directions relative to an image forming apparatus main unit and configured in an open state to be stacked with sheets;

bearing portions formed in one of the image forming apparatus main unit and said open-close cover and each formed with an opening;

elastically deformable arm portions extending to another of the image forming apparatus main unit and said open-close cover respectively from vicinities of parts of the one of the image forming apparatus main unit and said open-close cover where said bearing portions are formed;

first stopper portions respectively provided at tip ends of said arm portions;

second stopper portions respectively provided in the one of the image forming apparatus main unit and said open-close cover at locations spaced away from said first stopper portions;

shaft portions provided in the other of the image forming apparatus main unit and the open-close cover and configured to be fitted respectively into said bearing portions through the openings;

first receiving portions provided in the other of the image forming apparatus main unit and the open-close cover and configured to be engaged respectively with said first stopper portions when said open-close cover is in the open state, thereby restricting an open angle of said open-close cover; and second receiving portions provided in the other of the image forming apparatus main unit and the open-close cover and configured to be engaged respectively with said second stopper portions, wherein in a case where said open-close cover, which is in the open state that said first stopper portions are engaged respectively with said first receiving portions, is applied with a force acting in a direction to open said open-close cover, said first stopper portions are elastically deformed respectively so as to be disengaged respectively from said first receiving portions, whereas said second stopper portions are engaged respectively with said second receiving portions so as to prevent said shaft portions from being disengaged respectively from said bearing portions, wherein in a case where said open-close cover, which is in a state that said second stopper portions are engaged respectively with said second receiving portions, is applied with a further force acting in the direction to open said open-close cover, said second stopper portions are disengaged respectively from said second receiving portions so as to allow said shaft portions to be disengaged from said bearing portions through the openings respectively, and wherein the force which is required to disengage said first stopper portions from said first receiving portions and acts in the direction to open said open-close cover is greater than the force which is required to disengage said second stopper portions from said second receiving portions and acts in the direction to open said open-close cover.

2. The open-close cover assembly according to claim 1, wherein said second stopper portions are engaged with said second receiving portions before said first stopper portions have been disengaged from said first receiving portions.

3. The open-close cover assembly according to claim 1, wherein loads required to disengage said second stopper portions from said second receiving portions are smaller than loads required to disengage said first stopper portions from said first receiving portions.

4. The open-close cover assembly according to claim 3, wherein a distance between a center of each of said shaft portions and a corresponding one of said first stopper portions is longer than a distance between the center of said shaft portion and a corresponding one of said second stopper portions.

5. The open-close cover assembly according to claim 1, wherein when said open-close cover is in the open state, image-formed sheets discharged upward from the image forming apparatus main unit are placed upright and stacked on said open-close cover.

6. An apparatus having an apparatus main unit and an open-close cover supported for rotation in opening and closing directions relative to the apparatus main unit and configured in an open state to be stacked with sheets, wherein:

one of the apparatus main unit and the open-close cover includes:

bearing portions each having a circumferential part notched to form an opening that has opposite circumferential ends;

arm portions each configured to extend from one of the opposite circumferential ends of the opening of a corresponding one of said bearing portions and each having an elastically deformable first stopper portion; and second stopper portions provided at locations spaced respectively away from said first stopper portions, and another of the apparatus main unit and the open-close cover includes:

pivot shafts configured to be fitted respectively into said bearing portions through the openings;

first receiving portions engaged respectively with said first stopper portions when the open-close cover is in the open state, thereby restricting an open angle of the open-close cover; and second receiving portions configured to be engaged respectively with said second stopper portions wherein in a case where said open-close cover, which is in the open state that said first stopper portions are engaged respectively with said first receiving portions, is applied with a force acting in a direction to open said open-close cover, said first stopper portions are elastically deformed respectively so as to be disengaged respectively from said first receiving portions, whereas said second stopper portions are engaged respectively with said second receiving portions so as to prevent said shaft portions from being disengaged respectively from said bearing portions, wherein in a case where said open-close cover, which is in a state that said second stopper portions are engaged respectively with said second receiving portions, is applied with a further force acting in the direction to open said open-close cover, said second stopper portions are disengaged respectively from said second receiving portions so as to allow said shaft portions to be disengaged from said bearing portions through the openings respectively, and wherein the force which is required to disengage said first stopper portions from said first receiving portions and acts in the direction to open said open-close cover is greater than the force which is required to disengage said second stopper portions from said second receiving portions and acts in the direction to open said open-close cover.

* * * * *